United States Patent [19]

Fukuda et al.

[11] 3,947,238

[45] Mar. 30, 1976

[54] METHOD AND APPARATUS FOR DISPERSING POWERED MATERIAL IN A COMBUSTION CHAMBER

[75] Inventors: Yoshiharu Fukuda, Tokyo; Yoshihiko Ueda, Musashino, both of Japan

[73] Assignee: Onoda Cement Co., Ltd., Onoda, Japan

[22] Filed: Oct. 25, 1974

[21] Appl. No.: 518,046

[30] Foreign Application Priority Data

Oct. 29, 1973 Japan ..... 48-121370

[52] U.S. Cl. ..... 432/14; 432/106

[51] Int. Cl.[2] ..... F27B 15/00

[58] Field of Search ..... 432/14, 15, 58, 16, 106; 34/10, 57 R, 57 E

[56] References Cited

UNITED STATES PATENTS

| | | | |
|---|---|---|---|
| 1,468,168 | 9/1923 | Pike | 432/106 |
| 2,580,235 | 12/1951 | Lellep | 432/61 |
| 3,146,998 | 9/1964 | Golucke et al. | 432/58 |
| 3,452,968 | 7/1969 | Shimizu et al. | 432/58 |
| 3,491,991 | 1/1970 | Abelitis | 432/16 |
| 3,752,455 | 8/1973 | Zacpal et al. | 432/58 |
| 3,834,860 | 9/1974 | Fukuda et al. | 432/58 |
| 3,843,314 | 10/1974 | Ishikawa | 432/58 |
| 3,869,248 | 3/1945 | Hirai et al. | 432/58 |
| 3,881,862 | 5/1975 | Nishida et al. | 432/106 |
| 3,904,353 | 9/1975 | Bosshand et al. | 432/106 |

*Primary Examiner*—John J. Camby
*Assistant Examiner*—Henry C. Yuen
*Attorney, Agent, or Firm*—Millen, Raptes & White

[57] ABSTRACT

A method and apparatus for thoroughly dispersing powdered material in a combustion chamber of a furnace in combination with a suspension preheater and a kiln to improve combustion efficiency. The material is introduced as a free falling stream in the upper zone of the combustion chamber and is contacted in the upper zone with recycled gases from a cooler and a second gas introduced at a higher velocity than said recycled gases, whereby the powdered material is thoroughly dispersed throughout said combustion chamber and heat exchange between the material and gases is enhanced.

6 Claims, 5 Drawing Figures

METHOD AND APPARATUS FOR DISPERSING POWERED MATERIAL IN A COMBUSTION CHAMBER

This invention relates to a method and apparatus device for effectively dispersing powered material supplied into the combustion chamber of a furnace and at the same time, enhancing the efficiencies of combustion therein with heavy oil utilizing recycled hot air from the cooler, heat exchange with conduction by swirling air, and controlling the volume of air throughout the heating apparatus including a suspension preheater and furnace.

More particularly in the suspension preheater and furnace for calcining cement material by combustion of heavy oil therein, the present invention contemplates to economically promote the dissolution of material with better heat exchange thereby to increase calcining efficiency of the kiln and avoid problems with bricks of the furnace caused by coating of material thereon.

One conventional heating device is shown in FIG. 3 in which the numeral 1 is a kiln from which a duct having a throttle 4 is upstanding. The resistance of the throttle 4 is made somewhat larger than that of another duct 5 so as to suction hot air into the furnace 3. Another conventional heating device is shown in FIG. 4 in which the whole volume of air to be used in the furnace 3 is blown with fan 6 provided in a duct 5 from the cooler 10. Even with the provision of a throttle 4, this can only supplementally maintain a proper draft in the kiln system.

In the former (FIG. 3) since no operative means is provided in the duct 5, there will not occur any trouble in the duct except the deposit of dust therein. However on the other hand, due to changes of operational conditions of the device, the air flow resistance of the throttle 4 and duct 5 can become unbalanced. For example, assume that the size of the throttle 4 is set for balancing the draft in the normal operation, then a. If fly dust deposits in the throttle 4, air flow resistance therein will be increased.

b. If residues deposit in to the kiln, air flow resistance in the throttle 4 will be increased.

c. If the operation is not normal, there will occur a difference in air flow resistances in the throttle 4 and duct 5 to cause an unbalance of air flow therebetween.

d. If dust deposits in the duct 5 extending from the cooler 10 to the furnace 3, its air flow resistance will increase.

The change of such air flow resistance will cause a lack or excess of air necessary for combustion which prevents the stable operation of the furnace with resulting problems.

In the latter method (FIG. 4), since this is not subject to mutual interference of air flow resistance, each of the throttle 4 and duct 5 can be set with an appropriate air ratio for combustion to enable stable operation.

However, on the other hand, since the temperature of hot air from the cooler 10 rises to as high as 650° – 750°C and since clinker particles of abrasive nature can be be contained in the hot air, the fan 6 is often damaged.

The first object of the present invention is to improve the dispersion of material supplied to the furnace and to enhance the efficiencies of combustion and heat exchange by a swirling movement of the material.

The second object of the present invention is to diminish wear of the fan or other parts of the apparatus so as to ease maintenance.

The third object of the present invention is to set the volume of necessary air in the furnace by means of a fan at the predetermined rate even when there occurs difference in the air resistances between the throttle and duct.

To achieve these objects, the apparatus of the present invention includes a main air exhaust means to suction exhaust gas of the rotary kiln into a preheater and with the provision of a fan to blow hot air generated in the cooler connected to the rotary kiln into the furnace at higher speed than that of said hot air stream so that powder supplied to the furnace is given swirling movement therein. Said main air exhausting means and preheater are successively connected in the material inlet side, and the outlet of calcined material is connected to the cooler, and the cooler and the furnace are connected through a duct and an air inlet in tube with a fan is provided for blowing air into the path of falling material.

Figure 1:
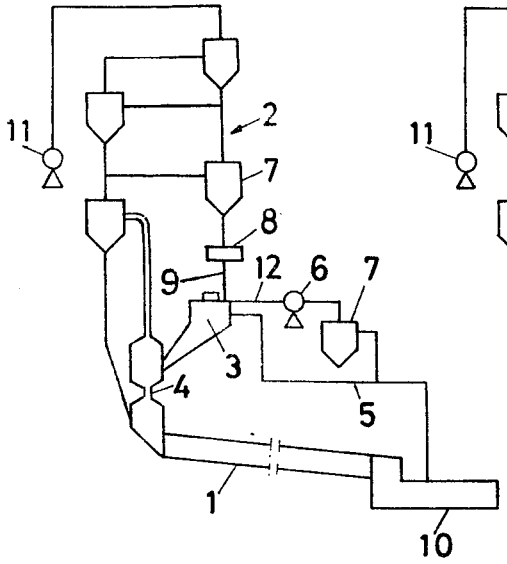
FIG. 1 is a diagrammatic side view of one embodiment of the present invention.
Figure 2:
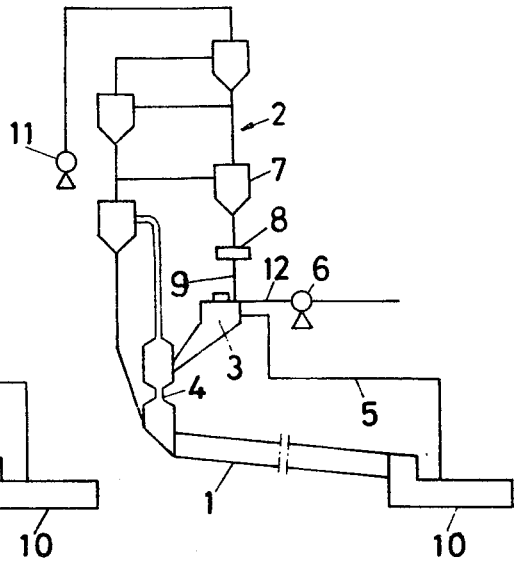
FIG. 2 is a diagrammatic side view of another embodiment of the present invention.
Figure 3:
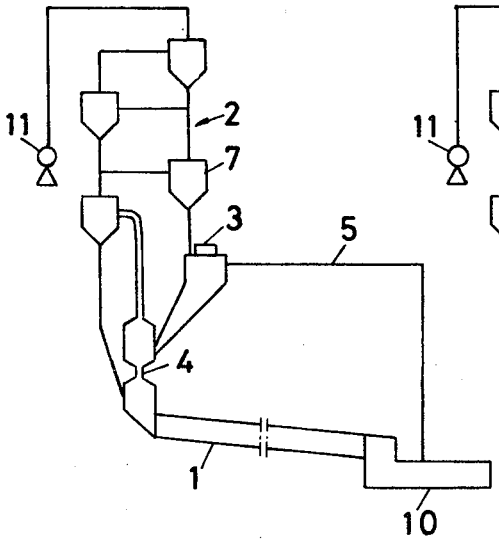
FIGS. 3 and 4 are, each diagrammatic side views of conventional furnaces.
Figure 4:
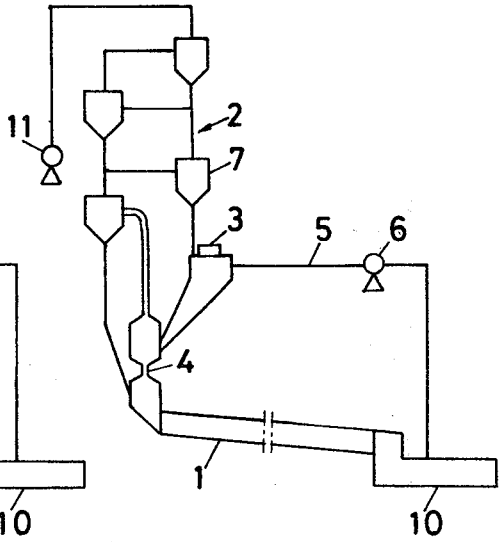
Figure 5:
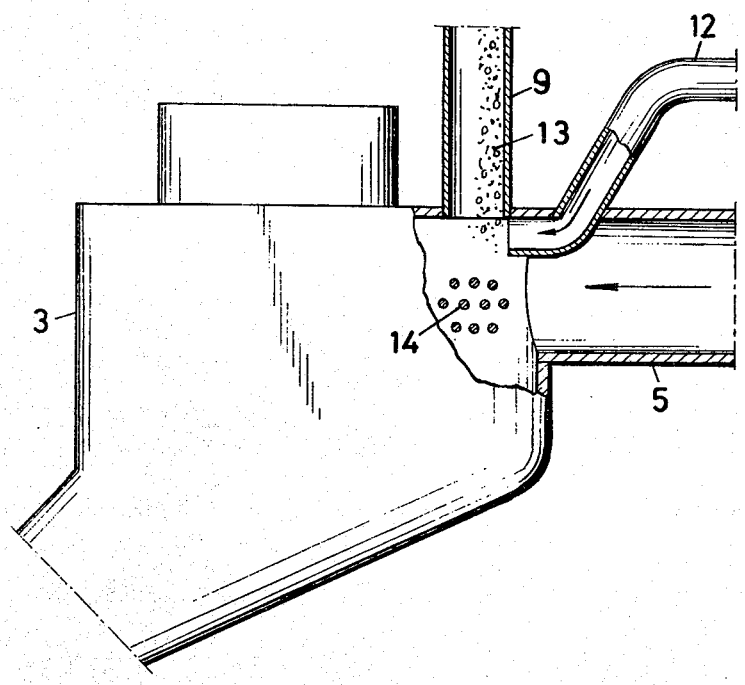
FIG. 5 is a fragmentary side view partially in part section view of the air and material inlets of the furnace of the present invention.

In FIG. 1 and FIG. 2, 1 is a rotary kiln, 2 is a suspension preheater, 3 is a combustion furnace communicated to said preheater, 4 is a throttle for draft balancing, 5 is a duct through which high temperature air from a cooler 10 passes to said furnace 3, and 6 is a fan for blowing air into powdered material and for dispersing the material. In FIG. 1, such fan is provided in the blowing tube 12 extending via a cyclone 7 to the duct 5. In FIG. 2, such fan is provided in the blowing tube 12 which directly communicates to the atmosphere. Another cyclone 7 is provided in a line from the preheater to the furnace. 8 is a flap damper, 9 is a shoot, and 11 is a main air exhaust means. Said blowing tube 12 extends to the furnace in tangential relation to the circumference of the furnace 3. 13 is powder material and 14 is a dispersion rod.

Powdered material falling through suspension preheater 2 is caught in the upper cyclone 7 and then passes through flap damper 8 and shoot 9 into the furnace 3. In the shoot 9, the material flow is considerable. If this flows down as it is into the furnace 3, the interior wall of the furnace 3, because of the high temperature of the very hot combustion gas, a part of the material fuses on the wall to become a coating which disturbs the circulation of gas in the furnace 3 and prevents combustion. Further this retards not only the heat conduction to the material but also interferes with the continuous operation of the furnace. For effective dispersion of the mass of powdered material falling down through the shoot 9, it is necessary to blow air an appropriate angle from the fan 6 through the air tube 12. Also for better circulation of air in the furnace 3, it is effective to blow air in a tangential direction to the furnace 3 or in an angle approximate thereto. The speed of air blown from the fan 6 should be higher than the rate, 30 m/sec. With a lower speed than this, coating troubles will occur in the furnace when the furnace is continuously operated for a long time. Thus the operation is forced to eventually cease.

Also this ratio should be determined with the volume of air to be blown into the furnace by the fan 6. Therefore it is necessary to determine the speed of air blown by the fan 6 so that a total of kinetic energy of the air introduced by the main air exhaust means 11 of the suspension preheater and air blown in the furnace with the fan 6 is to be always maintained over a certain amount. Such amount shall be determined by experiments because it varies depending on the volume of powdered material to be treated, the height of material shoot to the furnace, or the imparted inertia of material and its massive state. Further, the volume of air to be blown in the furnace by the fan 6 shall be 5% preferably 10% more than the volume of air needed for combustion. With a smaller volume than this, the dispersion of material will be insufficient.

Practially considering from the point of utilization of exhaust heat from the cooler, the smaller the air volume blown into the furnace by the fan the better it will be. However considering the case when there occurs an unbalance in air flow resistance between the throttle line 4 and duct line 5, it is necessary to adjust the air volume blown by the fan 6 so that the volume of air needed in the furnace may become constant and to maintain the speed of air blown in the furnace in proper range. For this, it was found after experiment it may be good to take consideration of a 40% spare at the highest. That is, no more volume of air is needed because excess of air results in heat loss.

What is claimed is:

1. A method of thoroughly dispersing powdered material into a combustion chamber of a furnace, wherein said material is introduced into the top of said combustion chamber from a suspension preheater including air exhaust means, and wherein said material is combusted in said combustion chamber and is passed to a calcining chamber and cooling zone, and wherein gases from said cooling zone are recycled to said combustion chamber, comprising introducing said recycled gases to the upper zone of said combustion chamber, introducing a second gas into said upper zone at a velocity greater than said entering recycled gases, introducing said material as a free falling stream into said upper zone of said combustion chamber and contacting said free falling stream of material with said recycled gases and second gas prior to combustion of said material in said combustion chamber, to thereby give said gases and material a swirling motion and to thoroughly disperse said material in said chamber.

2. The method of claim 1, wherein said second gas comprises a portion of said recycled gases.

3. The method of claim 1, wherein said second gas is introduced tangentially into said upper zone.

4. The method of claim 1, wherein said second gas introduced is in an amount 5% to 10% by volume greater than that required for combustion of said material.

5. The method of claim 1, wherein said second gas comprises atmospheric air.

6. An apparatus for thoroughly dispersing powdered material into a combustion chamber of a furnace wherein combustion thereof takes place, comprising, in combination, suspension preheater means, furnace means, kiln means, and cooling means, for introducing said material from said preheater means as a falling stream into the upper part of said combustion chamber, means for recycling gases from said cooling means into the upper part of said combustion chamber, means including blower means for introducing a second gas into the upper part of said combustion chamber at a velocity greater than the velocity of said recycled gases, said gas recycling means and second gas introducing means disposed in said upper part of said combustion chamber adjacent said material introducing means, whereby said falling stream of material contacts said recycled gases and second gas prior to combustion of said material in said combustion chamber, to thereby give said gases and said material a swirling motion and to thoroughly disperse said material in said chamber.

* * * * *